US007588196B2

(12) United States Patent
Kubota et al.

(10) Patent No.: US 7,588,196 B2
(45) Date of Patent: Sep. 15, 2009

(54) CARTRIDGE-TYPE COATING MACHINE AND CARTRIDGE THEREOF

(75) Inventors: Tetsuro Kubota, Aichi-ken (JP); Shinji Tani, Aichi-ken (JP); Kazumi Ichihara, Toyota (JP); Hidetsugu Matsuda, Fujieda (JP)

(73) Assignees: Toyota Jidosha Kabushiki Kaisha, Toyota-Shi (JP); ABB K.K., Tokyo (JP)

( * ) Notice: Subject to any disclaimer, the term of this patent is extended or adjusted under 35 U.S.C. 154(b) by 607 days.

(21) Appl. No.: 11/057,616

(22) Filed: Feb. 15, 2005

(65) Prior Publication Data

US 2005/0189435 A1 Sep. 1, 2005

(30) Foreign Application Priority Data

Feb. 20, 2004 (JP) ..... 2004-044441

(51) Int. Cl.
*B05B 3/10* (2006.01)

(52) U.S. Cl. ..... 239/223; 239/305; 239/309; 239/327; 239/328; 222/92; 222/325

(58) Field of Classification Search ..... 239/112, 239/223, 224, 309, 302–305, 327, 328; 222/92, 222/107, 206, 215, 325, 394, 395; 118/300, 118/302, 323
See application file for complete search history.

(56) References Cited

U.S. PATENT DOCUMENTS 5,882,735 A 3/1999 Takeuchi
6,071,346 A * 6/2000 Yamauchi et al. ..... 118/302
6,164,561 A 12/2000 Yoshida et al.
6,179,217 B1 * 1/2001 Yoshida et al. ..... 239/305
6,439,480 B1 * 8/2002 Velde ..... 239/327
6,533,861 B1 * 3/2003 Matsuda et al. ..... 239/223
7,014,713 B2 * 3/2006 Nakane ..... 222/325

FOREIGN PATENT DOCUMENTS

| | | |
|---|---|---|
| DE | 29615000 U1 | 10/1996 |
| EP | 1057539 A1 | 12/2000 |
| JP | 09-168766 | 6/1997 |
| JP | 11-262669 | 9/1999 |
| JP | 2001-518010 | 10/2001 |
| WO | WO 98/43745 | 10/1998 |

* cited by examiner

*Primary Examiner*—Steven J Ganey
(74) *Attorney, Agent, or Firm*—Finnegan, Henderson, Farabow, Garrett & Dunner, LLP

(57) ABSTRACT

An object of the present invention is to provide a cartridge-type coating machine having a coating device for spraying paint, to which a simple, light and inexpensive cartridge for storing paint therein and for supplying the paint to the coating device is detachably attached. In a coating machine 11, a coating device having a rotary atomizing head 14 and the like is disposed at a front part of a housing 12, and a cartridge 21, in which paint is stored, is detachably attached to a rear part of the housing 12. Paint in the cartridge 21 is supplied to the rotary atomizing head 14 by pressurizing the cartridge 21 by liquid fluid, and a pressure solvent storage chamber 18*b* for storing the liquid fluid is formed by the housing 12 and the cartridge 21.

10 Claims, 14 Drawing Sheets

CARTRIDGE-TYPE COATING MACHINE AND CARTRIDGE THEREOF

BACKGROUND OF THE INVENTION

1. Field of the Invention

The present invention relates to a cartridge-type coating machine to which a cartridge for storing paint therein is detachably attached, and relates to the cartridge thereof.

2. Background Art

A rotary atomizing head type coating machine is used widely for coating a target such as a car body.

Recently, coating is desired to be more inexpensive, and to deal with multicoloring for heightening a design quality. Therefore, the coating machine is required to reduce the amount of paint and solvent wasted at the time of changing colors, and to deal with a large number of colors.

To reduce the wasted paint and solvent and to increase colors, there is a conventional rotary atomizing head type coating machine provided with cartridges for storing respective paints of different colors, which are exchangeable to be selectively attached to the coating machine to correspond to a coated target such as a car body.

For example, as described in the Japanese Patent Laid Open Gazette Hei. 11-262699, this rotary atomizing head type coating machine comprises a housing. A front part of the housing is a coating device attachment part to which a coating device is attached. A rear part of the housing is a cartridge attachment part. The coating device includes an air motor having a rotary shaft, and a rotary atomizing head provided on the rotary shaft in front of the air motor.

A feed tube insertion hole, whose front end is opened to the rotary atomizing head and whose rear end is opened to the cartridge attachment part of the housing, is formed axially in the rotary shaft of the air motor constituting the coating device.

In the rotary atomizing head type coating machine, the cartridge is detachably attached to the housing. This cartridge comprises a bomb, in which paint is stored, and a feed tube extended axially outward from the bomb. The bomb is detachably attached into the cartridge attachment part of the housing, and the feed tube is inserted into the feed tube insertion hole.

Cartridges storing respective paints of different colors are prepared, so that one of the cartridges can be selectively attached to the coating machine so as to correspond to a color used for coating.

The cartridge is provided therein with a movable partition. A space in the bomb is divided by the partition into a paint storage chamber, communicated with the feed tube, and an pressure air storage chamber. The cartridge is also provided therein with a cartridge-side pressure air passage for supplying pressure air to the pressure air storage chamber.

Furthermore, the housing is provided therein with a housing-side pressure air passage communicated with the cartridge-side pressure air passage.

By charging pressure air into the pressure air storage chamber through the housing-side and cartridge-side pressure air passages, the movable partition is moved so as to pass paint in the paint storage chamber to the rotary atomizing head through the feed tube.

With regard to the rotary atomizing head type coating machine constructed as the above, a cartridge of a color used for coating is selected from the cartridges of respective colors, and the selected cartridge is attached to the cartridge attachment part of the housing.

Then, by optionally supplying air to the pressure air storage chamber of the cartridge, paint in the paint storage chamber of the cartridge is discharged through the feed tube to the rotary atomizing head. Accordingly, the rotary atomizing head sprays this paint toward a target.

By exchanging the cartridge for a cartridge of another color, coating color can be changed without wasting paint and solvent.

On the other hand, when the cartridge is removed for switching the coating colors after finishing the coating, there is little residual paint in the paint storage chamber. Accordingly, it is necessary to refill the cartridge with paint.

A paint filler for filling the cartridge with paint comprises quick joints extended from paint circulation pipings of respective colors. At the time of filling the paint storage chamber of the cartridge with paint by the paint filler, the cartridge is detached from the housing and returned to a disposition rack. Next, a paint feed opening provided in the cartridge separately from the feed tube is connected to the quick joint so that the cartridge is filled with paint through the quick joint.

However, with regard to the cartridge of the art described in the Japanese Patent Laid Open Gazette Hei. 11-262699, the bomb part, in which paint is stored, and the feed tube part, for guiding the paint in the bomb toward the rotary atomizing head, are formed integrally, and a piston for pressing out the paint from the bomb is disposed in the cartridge, whereby the whole cartridge becomes large and weight thereof increases.

When the empty cartridge is filled with paint, it is necessary to convey not only the paint storage part but the whole cartridge, whereby the handling of the cartridge is complicated and a conveying equipment becomes large.

Furthermore, the cartridges must be provided so as to correspond to the required number of cartridges of each color, and coating lines must be operated so as to correspond to the number of required colors. Accordingly, the number of the cartridges becomes large, and the cartridges, constructed integrally with the paint storage parts and mechanisms for pressing out paint, increase costs.

Moreover, even if any disorder occurs in only the bomb part or only the piston part, the whole cartridge becomes no longer usable.

BRIEF SUMMARY OF THE INVENTION

An object of the present invention is to provide a cartridge which is simple, light and economic.

To achieve the object, a cartridge-type coating machine comprises: a coating device disposed at a front part of a housing; and a cartridge for storing paint therein and detachably attached to a rear part of the housing. The paint in the cartridge is supplied to an atomizing head of the coating device by pressurizing the cartridge by liquid fluid. A storage chamber, in which the liquid fluid is stored, is formed by the housing and the cartridge.

Accordingly, the cartridge does not require another mechanism for pressing paint, whereby the cartridge can be reduced in weight, size and cost. A conveying equipment for the cartridge can also be miniaturized.

The cartridge comprises a paint unit, in which paint is stored, and a casing, to which the paint unit is attached. The storage chamber is a space surrounded by an inner wall of a cartridge storage chamber to which the cartridge is attached, a side wall of the paint unit of the cartridge, and frames of the casing disposed at both sides of the paint unit. The paint is supplied to the atomizing head by pressurizing the side wall of the paint unit by the liquid fluid.

Accordingly, the side wall of the paint unit is pressurized wholly equally by pressure solvent in the storage chamber, whereby paint is effectively and accurately pressed out.

The cartridge comprises a paint unit, in which paint is stored, and a casing, to which the paint unit is attached. The paint unit comprises a paint storage chamber formed by a paint storage tube serving as a side wall of the paint storage chamber, and plate members blocking both ends of the paint storage tube. The paint storage tube is formed of a flexible membrane body easily deformable by external pressure.

Accordingly, the paint unit is fixed at its front part to the casing and guided at its rear part, and then pressurized from the side, whereby the tube is difficult to be warped during its volume reduction. Accordingly, excessive bending of a surface of the tube following the reduction of the stored paint is restrained so that paint is supplied smoothly.

By reducing the bending degree of the paint storage tube, load applied on the paint storage tube can be reduced so as to improve durability of the paint storage tube.

Accordingly, the paint storage tube can be easily refilled with paint so as to improve its recyclability, thereby reducing the recycling cost of the paint unit.

The cartridge comprises a paint unit, in which paint is stored, and a casing, to which the paint unit is attached. The paint unit is detachably attached to the casing.

Accordingly, the only thing required for filling the empty paint unit with paint is to convey the light and handy empty paint unit to a place for filling of paint, whereby a conveying equipment can be miniaturized.

The liquid fluid is a non-polar solvent.

Accordingly, paint can be controlled easily, and high voltage at the time of electrostatic coating can be treated so as to reduce the possibility of a short-circuit. Accordingly, electrification of paint particles is not inhibited and the coating can be performed stably. The pressure solvent can also be used as a pressing means at the time of washing.

The cartridge is detachably attached to a cartridge storage chamber formed in a housing of the coating machine; and a space is formed between an inner wall of the cartridge storage chamber and the cartridge when the cartridge is attached to the housing of the coating machine.

Accordingly, the cartridge is pressurized wholly equally by pressure solvent charged into the space between the inner wall of the cartridge storage chamber and the cartridge, thereby ensuring effective and accurate pressing-out of paint. Therefore, the cartridge does not require another mechanism for pressing paint, whereby the cartridge can be reduced in weight, size and cost. A conveying equipment for the cartridge can also be miniaturized.

The cartridge comprises a paint unit, in which paint is stored, and a casing, to which the paint unit is attached. The paint unit comprises a paint storage chamber formed by a paint storage tube serving as a side wall of the paint storage chamber, and plate members blocking both ends of the paint storage tube. The paint storage tube is formed of a flexible membrane body easily deformable by external pressure.

Accordingly, the paint unit is fixed at its front part to the casing and guided at its rear part, and then pressurized from the side, whereby the tube is difficult to be warped during its volume reduction. Accordingly, excessive bending of a surface of the tube following the reduction of the stored paint is restrained so that paint is supplied smoothly.

By reducing the bending degree of the paint storage tube, load applied on the paint storage tube can be reduced so as to improve durability of the paint storage tube.

Accordingly, the paint storage tube can be easily refilled with paint so as to improve its recyclability, thereby reducing the recycling cost of the paint unit.

The cartridge comprises a paint unit, in which paint is stored, and the casing, to which the paint unit is attached. The paint unit is detachably attached to the casing.

Accordingly, the only thing required for filling the empty paint unit with paint is to convey the light and handy empty paint unit to a place for filling of paint, whereby a conveying equipment can be miniaturized.

BRIEF DESCRIPTION OF THE DRAWINGS/FIGURES

Figure 8:
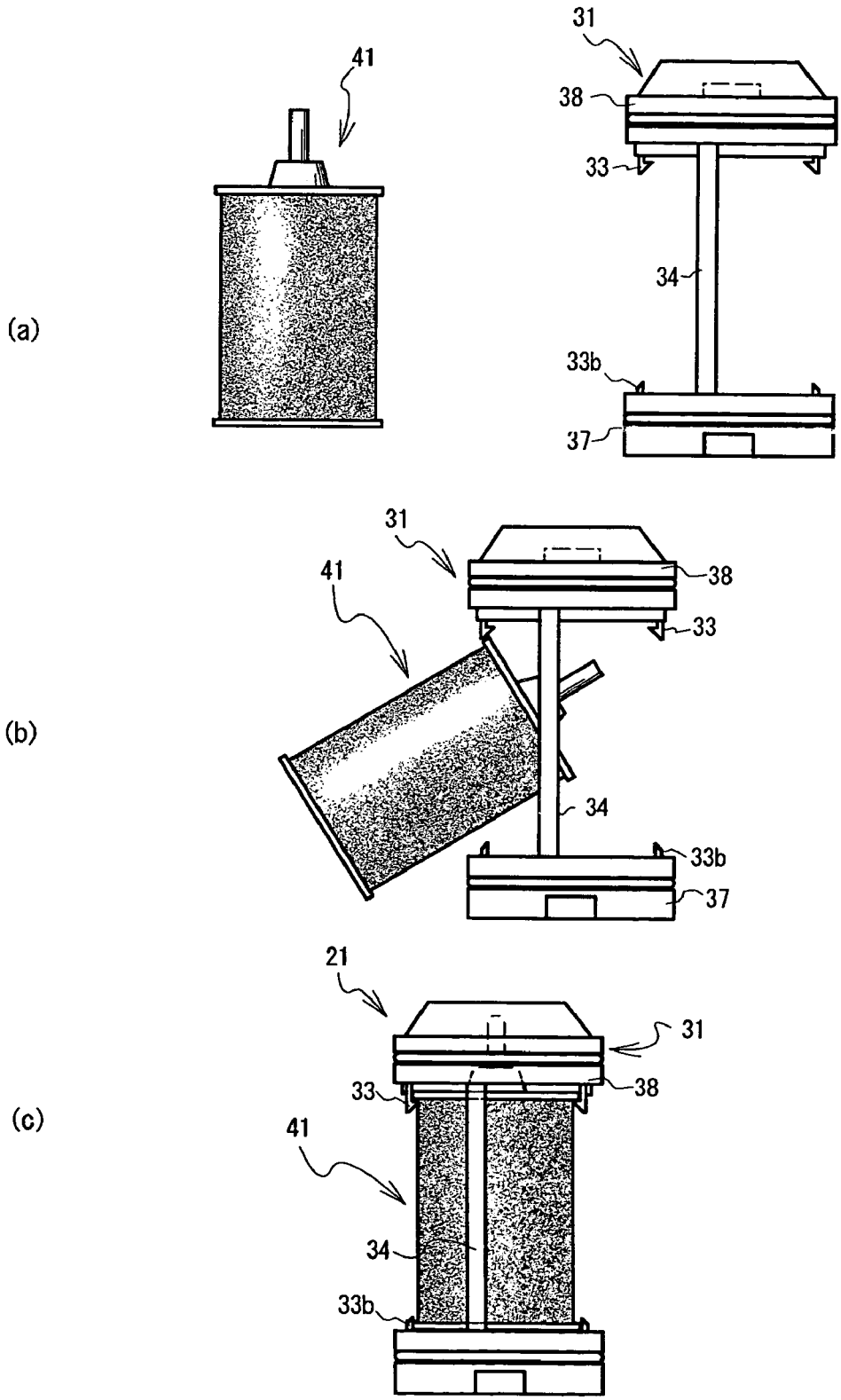

FIGS. 8(*a*), 8(*b*) and 8(*c*) illustrate a process of attaching the paint unit to the casing.

Figure 9:
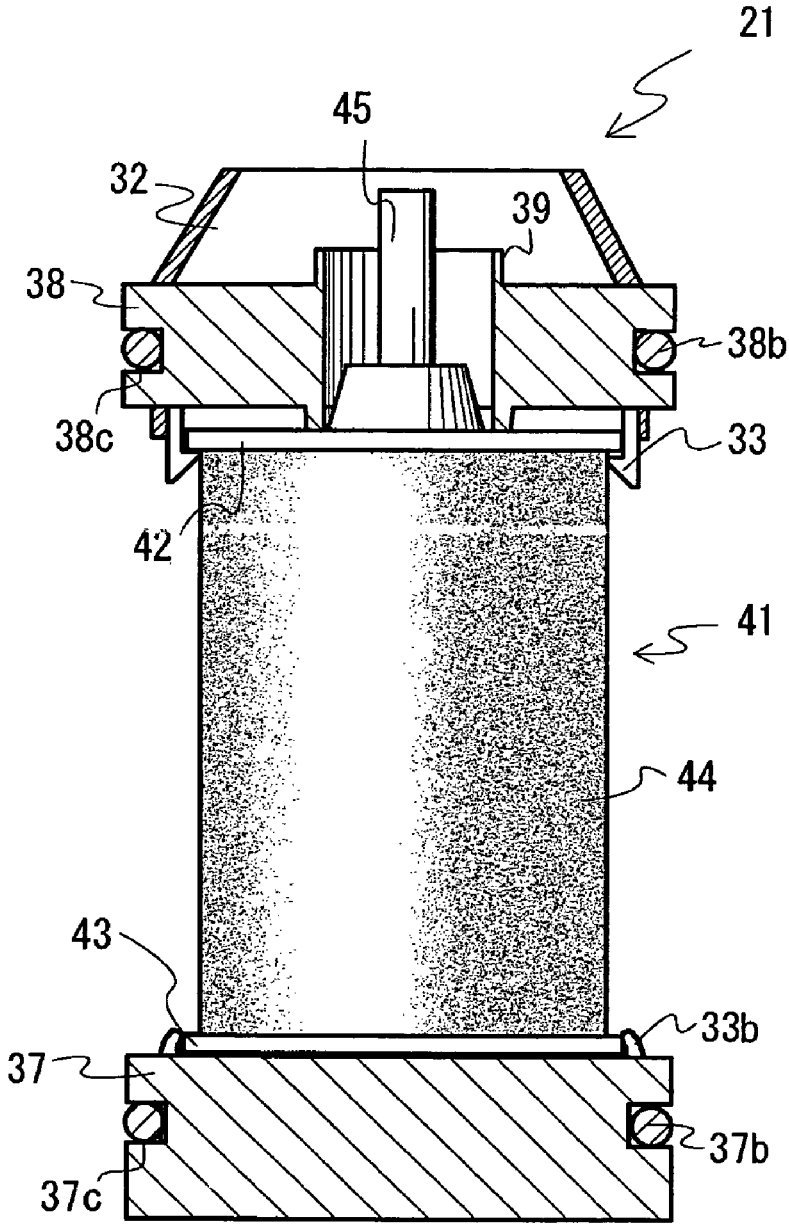

FIG. 9 is a sectional side view of the held paint unit.

Figure 10:
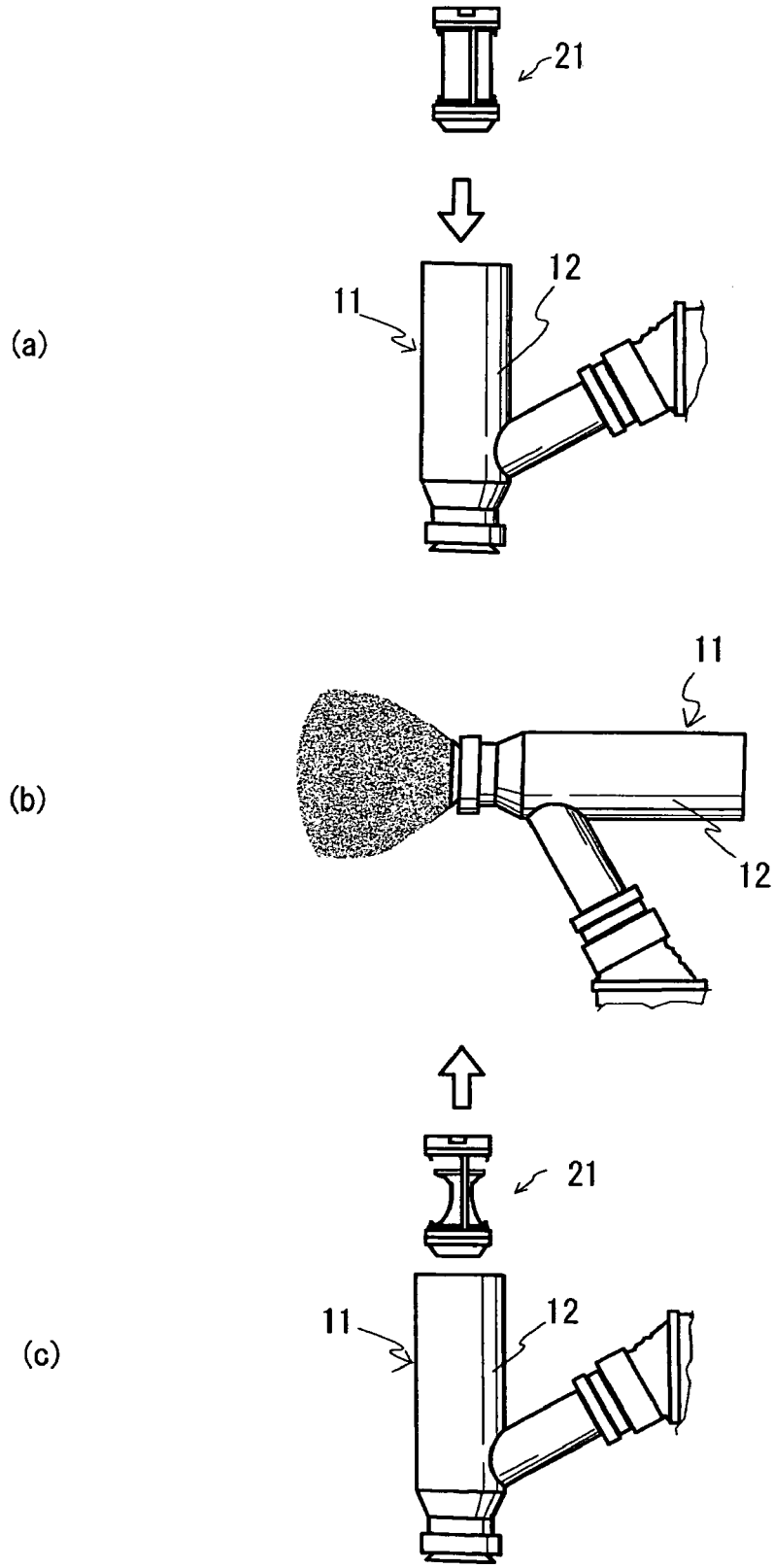

FIG. 10(*a*) illustrates the coating machine to which the cartridge is being attached, FIG. 10(*b*) illustrates the coating machine spraying paint, and FIG. 10(*c*) illustrates the coating machine from which the cartridge is being detached.

Figure 11:
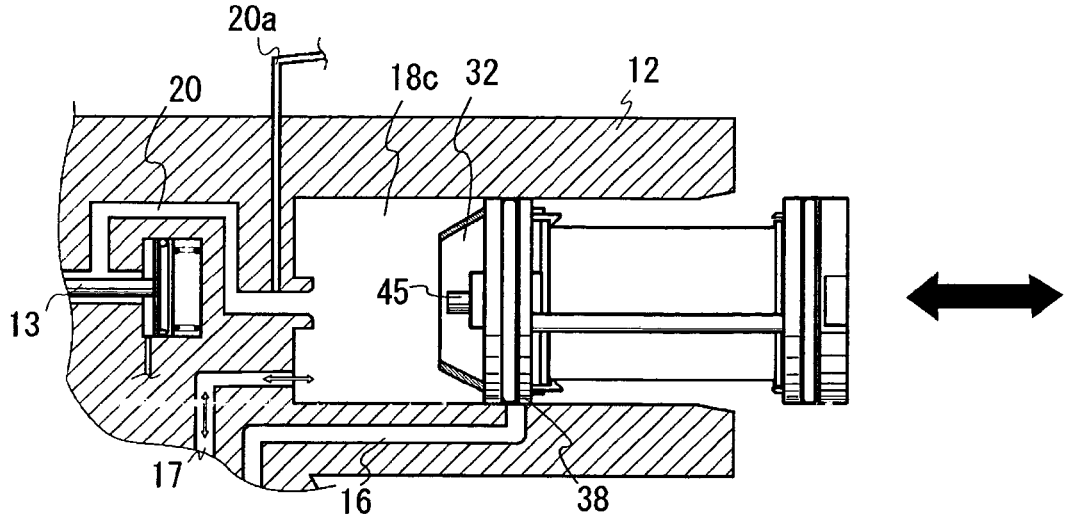

FIG. 11 is a sectional side view of a cartridge storage chamber storing the cartridge therein.

Figure 12:
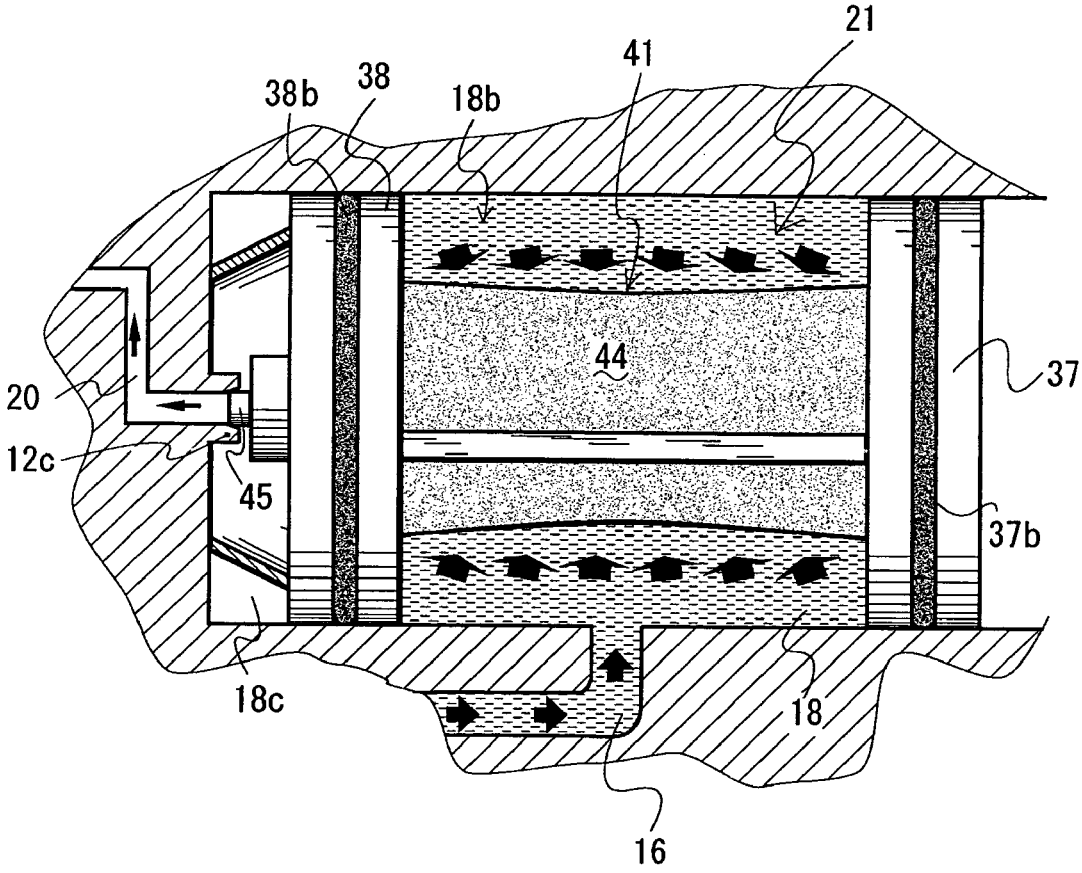

FIG. 12 is a schematic view of the cartridge pressurized by fluid pressure.

Figure 13:
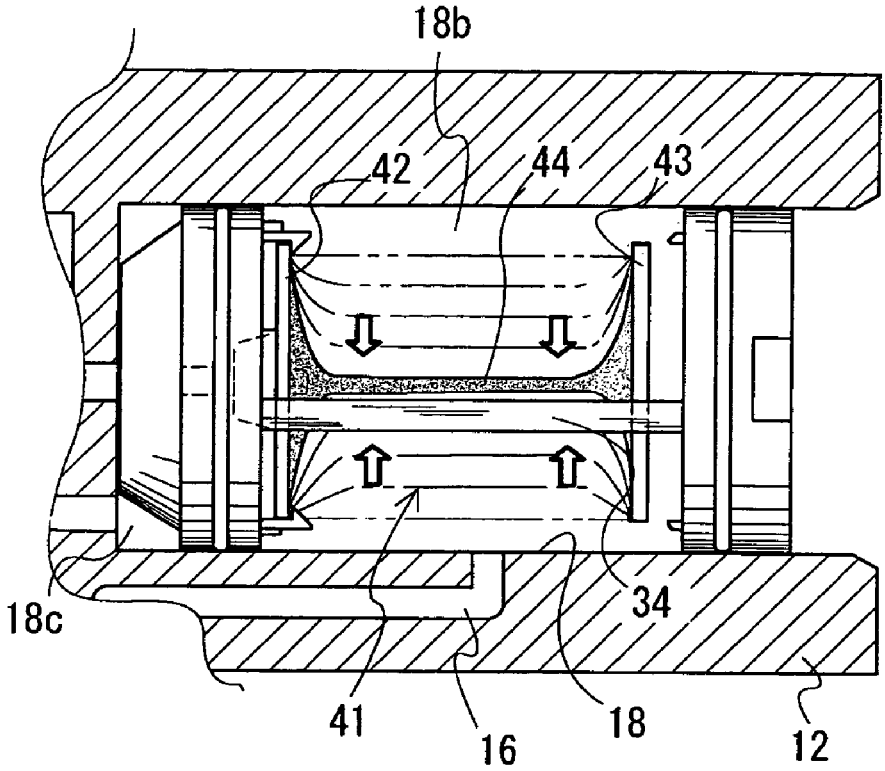

FIG. 13 is a side view of the paint unit during a contraction process.

Figure 14:
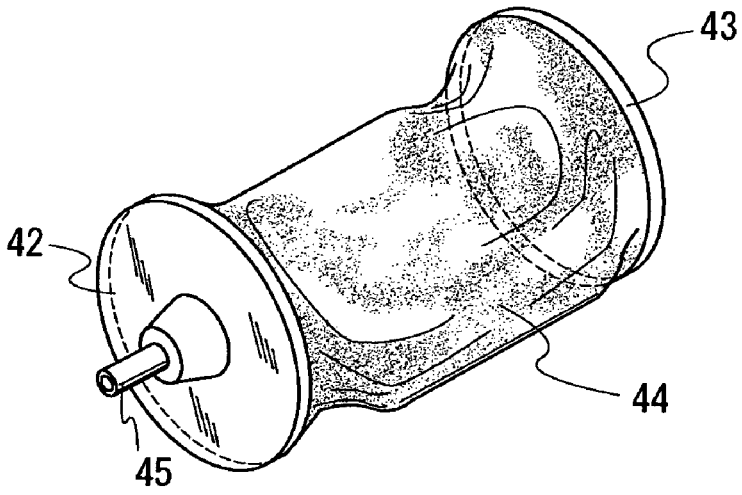

FIG. 14 is a perspective view of the paint unit emptied of paint therein.

DETAILED DESCRIPTION OF THE INVENTION

An embodiment of the present invention will be explained with reference to the accompanying drawings.

Coating Robot

Firstly, explanation will be given on a schematic construction of a coating robot 1 provided with a cartridge-type coating machine according to the present invention.

Figure 1:
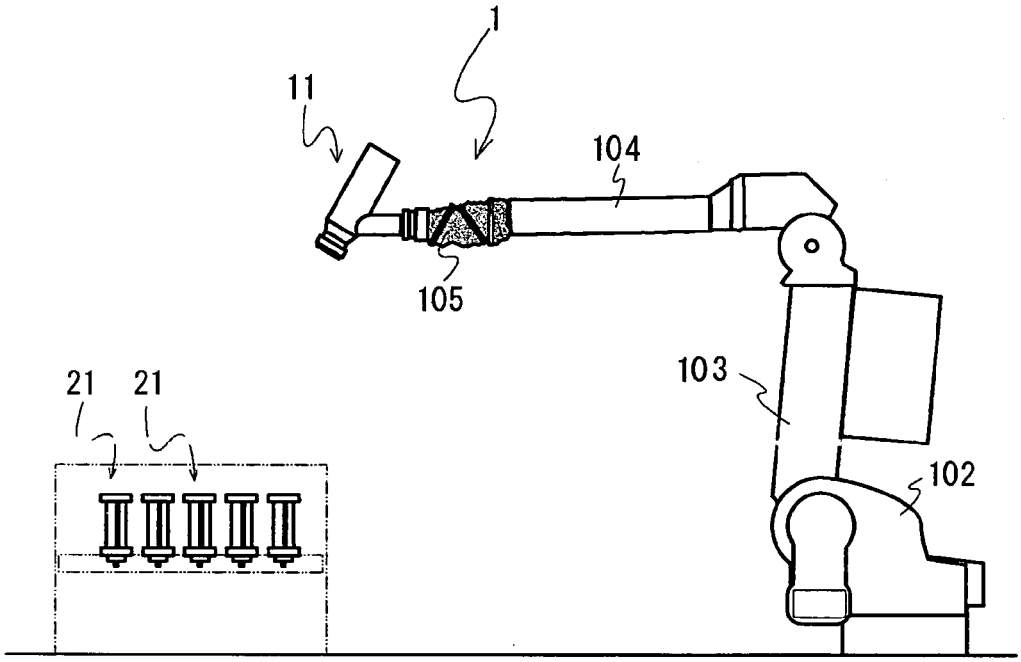
FIG. 1 is a view of a coating robot 1 provided with a cartridge-type coating machine according to the present invention.

FIG. 1 illustrates a coating robot 1 provided with a cartridge-type coating machine according to the present invention.

The coating robot 1 comprises a pedestal 102, a vertical arm 103 rotatably and swingably provided on the pedestal 102, an arm 104 swingably provided on a tip of the vertical arm 103, and an articulated part 105 provided at a tip of the arm 104. A cartridge-type rotary atomizing coating machine 11 is constructed at a tip of the articulated part 105.

The coating machine 11 is provided with an exchangeable cartridge 21 storing paint therein. An exchanger (not shown) automatically exchanges the cartridge 21 for another cartridge 21 conveyed from a storage place to the coating robot 1 by a conveyer (not shown).

To supply the replacing cartridge 21 to the coating robot 1, for example, the cartridge 21 may be inserted into a pneumatic tube, which connects the storage place of cartridges 21 to the coating robot 1, so as to be conveyed by air pressure.

Coating Machine

Figure 2:
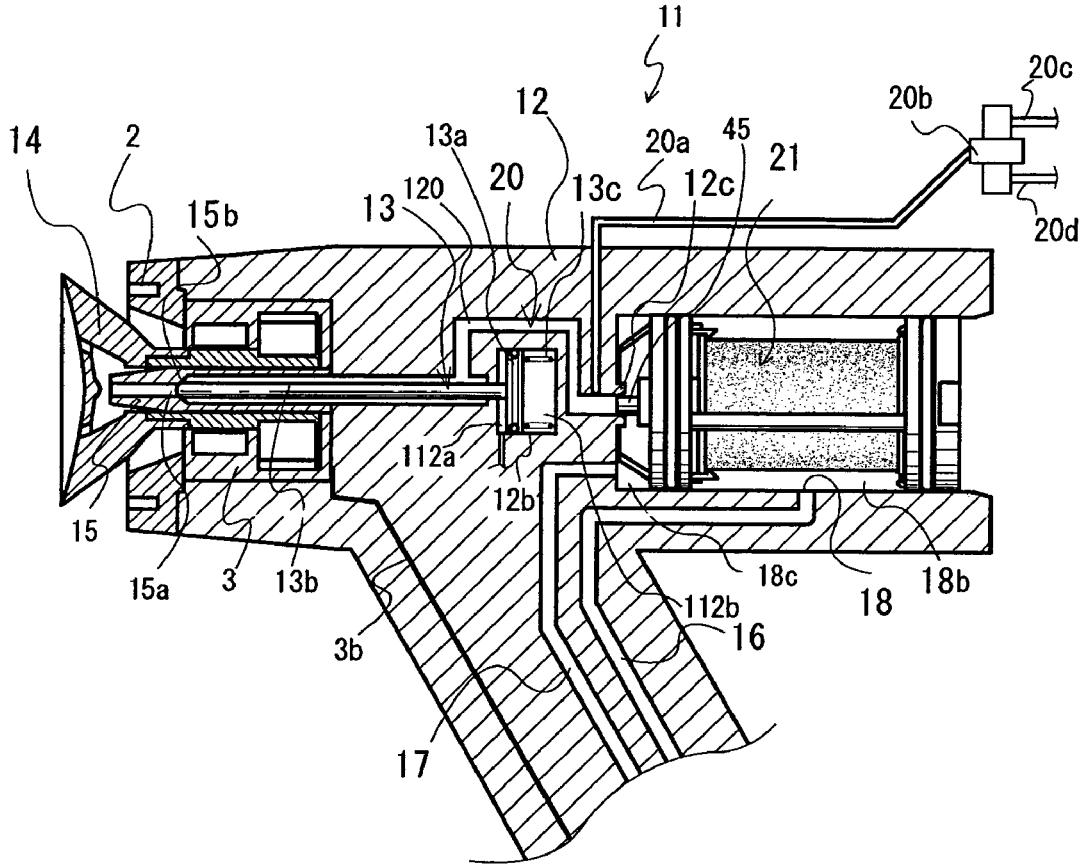
FIG. 2 is a sectional side view of the coating machine.

Next, explanation will be given on a schematic construction of the coating machine. FIG. 2 is a sectional side view of the coating machine.

In the following explanation, one side of the coating machine 11 at which a rotary atomizing head 14 is disposed (the left side in FIG. 2) is referred to as the front side thereof, and another side of the coating machine 11 at which the cartridge 21 is disposed (the right side in FIG. 2) is referred to as the rear side thereof.

The cartridge-type coating machine 11 shown in FIG. 2 comprises a housing 12, the rotary atomizing head 14, an air motor 3 driving the rotary atomizing head 14, the paint-storing cartridge 21 attached to the housing 12, a paint supply passage 20 for supplying paint from the cartridge 21 to the rotary atomizing head 14, and a paint valve 13 disposed in the middle of the paint supply passage 20.

A cartridge storage chamber 18 is formed at a rear part of the housing 12, and the cartridge 21 is detachably attached into the cartridge storage chamber 18. At a front part of the housing 12, the rotary atomizing head 14, the air motor 3 and the paint valve 13 are disposed so as to constitute a coating device for spraying paint supplied from the cartridge 21.

To supply paint from the cartridge 21 to the rotary atomizing head 14, pressure solvent is charged into a pressure solvent storage chamber 18*b* of the cartridge storage chamber 18 through a solvent passage 16 formed in the housing 12, so that an outer surface of the cartridge 21 is pressurized by the charged pressure solvent. The inner paint storage space of the pressurized cartridge 21 is reduced so that paint is pressed out from the cartridge 21, whereby the pressed paint is supplied to the rotary atomizing head 14 through the paint supply passage 20. The supplied paint is sprayed from the rotary atomizing head 14 driven by the air motor 3.

The paint valve 13 is controlled so as to select whether or not paint is supplied to the rotary atomizing head 14, thereby selecting whether or not the paint is sprayed.

The pressure solvent storage chamber 18*b* is a space formed between a side wall of the cartridge storage chamber 18 and the cartridge 21.

With regard to the coating machine 11, non-polar solvent with high electrical resistance is used as the pressure solvent charged into the cartridge storage chamber 18. By using the non-polar solvent, high voltage, which electrifies paint in the cartridge storage chamber 18 through the air motor 3 at the time of electrostatic coating, is prevented from being grounded through the pressure solvent. Accordingly, electrification of sprayed particles of paint is not inhibited and the coating can be performed stably.

Simple solvent, such as hexane, carbon tetrachloride, benzene, cyclohexane, and toluene, and mixture of the simple solvents are available as the non-polar solvent suitable for use conditions and used paints.

Next, explanation will be given on each of parts of the coating machine 11.

Housing

The housing 12 is formed of engineering plastic, such as PTFE, PEEK, PEI, POM, PI, PET or the like.

A high voltage cable 3*b* connected to a high voltage generator (not shown) is connected to the air motor 3 disposed at the front part of the housing 12 so that high voltage of about 30-100 kV is applied on the air motor 3 and the rotary atomizing head 14.

The cartridge storage chamber 18 formed at the rear part of the housing 12 is formed to be a cylinder whose rear end is opened, and the cartridge 21 is attached/detached through this opening. A paint lead-in part 12*c* is formed at a bottom (front end) of the cartridge storage chamber 18, and a tip of a nozzle 45 of the cartridge 21 is inserted into the paint lead-in part 12*c*.

Rotary Atomizing Head

The rotary atomizing head 14 is screwed and connected to a tip side (front side) of a rotation shaft of the air motor 3. The rotary atomizing head 14 is rotatively driven at high speed of about 10000-100000 rpm by the air motor 3. When the rotary atomizing head 14 is rotated, paint supplied to the rotary atomizing head 14 is electrified with high voltage through the rotary atomizing head 14 and atomized centrifugally, whereby electrified paint particles are generated and sprayed. By electrostatic induction, the electrified paint particles fly along an electrostatic field formed between the rotary atomizing head 14 and a grounded target, and adheres to the target.

Numeral 2 designates a shaping air ring. The shaping air ring 2 is attached in front of the air motor 3 so as to fix the air motor 3. At the outer peripheral side of the shaping air ring 2, a number of shaping air spraying holes are bored circularly so that shaping air is sprayed toward a discharge edge of the rotary atomizing head 14, thereby forming a pattern of the electrified paint particles discharged from the rotary atomizing head 14.

Paint Valve

The paint valve 13 comprises a piston part 13*a*, a valve body 13*b*, a spring 13*c* and a valve seat part 15*b*. The piston part 13*a* is longitudinally slidably inserted into a paint valve containing part 12*b* formed in the housing 12. A basal end side of the valve body 13*b* of the paint valve 13 is attached to the piston part 13*a*. The other side thereof is extended into a paint supply path 15*a* of a feed tube 15, and has a tip part to engage with/disengage from the valve seat part 15*b* provided at a middle of the paint supply path 15*a*. The spring 13*c* biases the valve body 13*b* through the piston part 13*a* to make it engage with the valve seat part 15*b*.

The piston part 13*a* divides the paint valve containing part 12*b* into a spring chamber 112*b* containing the spring 13*c* and a pressurized chamber 112*a* to which pilot air enters, whereby the paint valve 13 is constructed as an air pilot control valve.

When pilot air is not supplied to the pressurized chamber 112*a* of the paint valve containing part 12*b*, the valve body 13*b* of the paint valve 13 engages with the valve seat part 15*b* by biasing force of the spring 13*c* so as to block the paint supply path 15*a*. In the state that the paint supply path 15*a* is blocked by the valve body 13*b*, the supply of paint to the rotary atomizing head 14 is stopped.

On the other hand, when pilot air is supplied to the pressurized chamber 112*a* of the paint valve containing part 12*b*, the valve body 13*b* of the paint valve 13 disengages from the valve seat part 15*b* against the spring 13*c*, whereby paint in the cartridge 21 is supplied to the rotary atomizing head 14.

Paint Supply Passage

The paint supply passage 20 of the coating machine 11 is provided for supplying paint stored in the cartridge 21 to the rotary atomizing head 14. The paint supply passage 20 comprises: a paint supply path 120 formed in the housing 12; and the pa int supply path 15*a* in the feed tube 15, which is fixedly connected to the housing 12 and extended at its tip side to the rotary atomizing head 14.

The paint valve 13 is provided at the middle of the paint supply passage 20 and opens/closes the paint supply path 15*a* according to a desirable control command so as to select either supply or not of paint to the rotary atomizing head 14.

The feed tube 15 is formed of a member separated from the housing 12, and the valve seat part 15*b* for the paint valve 13 is formed in the feed tube 15.

The paint supply path 120 is opened at a bottom of the cartridge storage chamber 18, and the cylindrical paint lead-in part 12*c* is projected from this opening into the cartridge storage chamber 18. An air passage 17 is opened at the bottom of the cartridge storage chamber 18, and the pressure solvent passage 16 is opened at a side of the cartridge storage chamber 18.

When the cartridge 21 is stored in the cartridge storage chamber 18, an air storage chamber 18*c* and the pressure solvent storage chamber 18*b* are formed in the cartridge storage chamber 18, and a tip of the nozzle 45 of the cartridge 21 is inserted into the cylindrical paint lead-in part 12*c* and kept liquid-tight therein. The air passage 17 is communicated to the air storage chamber 18*c*, and the pressure solvent passage 16 is communicated to the pressure solvent storage chamber 18*b*.

The nozzle 45 of the cartridge 21 is a circular cylinder for discharging paint from the cartridge 21. An outside diameter of the nozzle 45 is slightly smaller than an inside diameter of the cylindrical paint lead-in part 12*c*.

Accordingly, when the cartridge 21 is stored in the cartridge storage chamber 18, the cylindrical paint lead-in part 12*c* can be certainly engaged with the nozzle 45 so that paint in the cartridge 21 can flow into the paint supply passage 20. Therefore, by making pressure solvent flow from the pressure solvent passage 16 to the pressure solvent storage chamber 18*b* with desired pressure, the paint in the cartridge 21 is pressed and supplied to the rotary atomizing head 14 through the paint supply passage 20.

A cleaning fluid passage 20*a* is connected to the paint supply passage 20 near the paint lead-in part 12*c*. A passage 20*c* for supplying cleaning air and a passage 20*d* for supplying cleaning solvent are connected to the cleaning fluid passage 20*a* through a control valve 20*b*.

Accordingly, cleaning fluid from a cleaning solvent source and a cleaning air source flows through the cleaning fluid passage 20*a*, whereby paint remaining in the paint supply passage 20 and the rotary atomizing head 14 can be cleaned out.

Paint Supply Circuit

Next, explanation will be given on a paint supply circuit in the coating machine 11.

Figure 3:
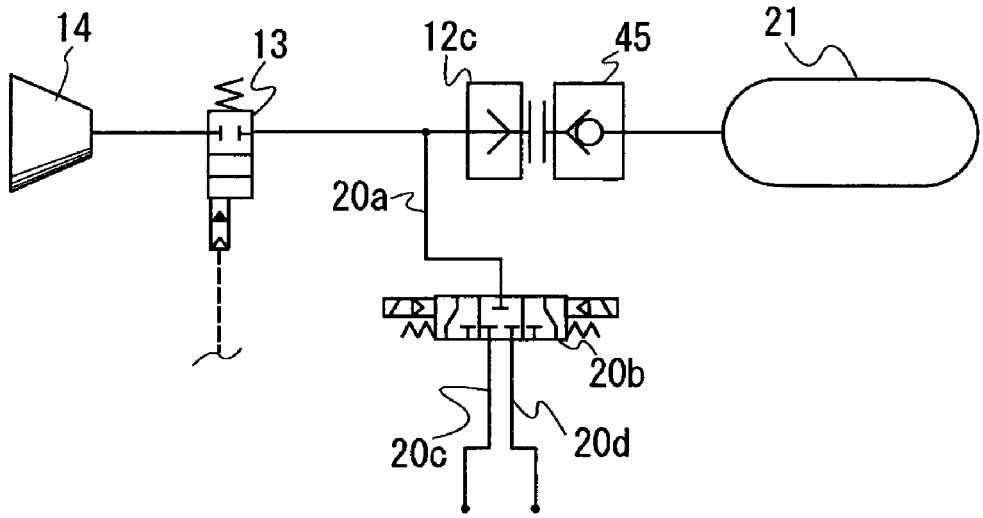
FIG. 3 is a diagram of a paint supply circuit in a state that a cartridge is not connected to a paint lead-in part.
Figure 4:
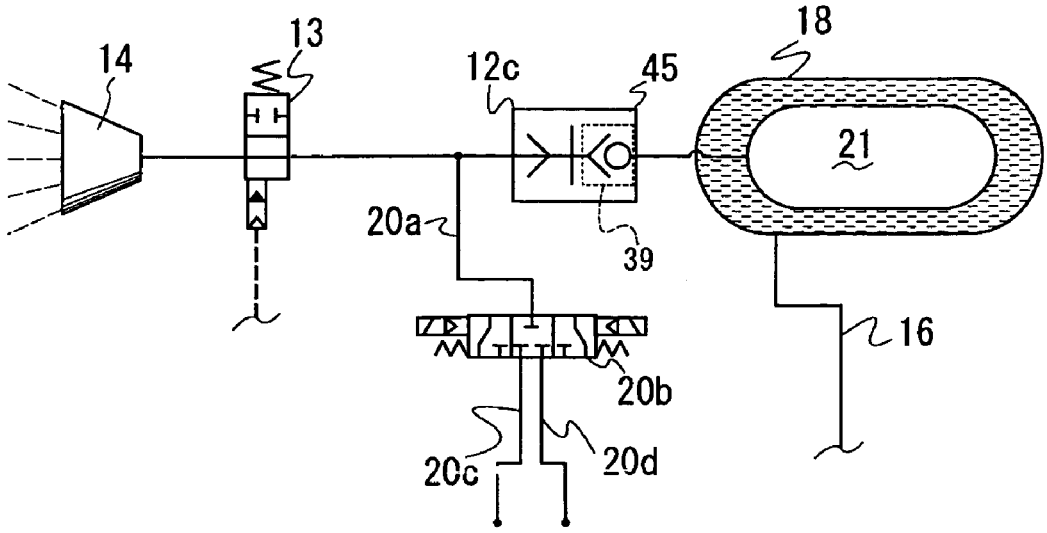
FIG. 4 is a diagram of the paint supply circuit in a state that the cartridge is connected to the paint lead-in part.

FIG. 3 shows the paint supply circuit in the state that the nozzle 45 of the cartridge 21 is not connected to the paint lead-in part 12*c*. FIG. 4 shows the paint supply circuit in the state that the nozzle 45 is connected to the paint lead-in part 12*c*.

A check valve is provided in the nozzle 45 of the cartridge 21. The check valve prevents paint in the cartridge 21 from flowing through the nozzle 45 when the nozzle 45 is not engaged with the paint lead-in part 12*c* (that is, in the state shown in FIG. 3), and permits paint in the cartridge 21 to flow to the paint supply passage 20 when the nozzle 45 is engaged with the paint lead-in part 12*c* (that is, in the state shown in FIG. 4). Accordingly, when the cartridge 21 is stored in the cartridge storage chamber 18, the paint lead-in part 12*c* is engaged with the nozzle 45, whereby paint in the cartridge 21 can be supplied to the rotary atomizing head 14 through the paint valve 13.

The paint valve 13 blocks/connects the paint supply passage 20 so as to control the supply or not of paint to the rotary atomizing head 14 from the cartridge 21.

For supplying paint in the cartridge 21 to the rotary atomizing head 14, pressure solvent is charged from a pressure solvent source into the pressure solvent storage chamber 18*b* through the pressure solvent passage 16 so as to push out the paint from the cartridge 21 to the paint supply passage 20, thereby supplying the paint to the rotary atomizing head 14.

At this time, a discharge amount of paint supplied to the rotary atomizing head 14 is controlled by adjusting the amount of the pressure solvent charged into the pressure solvent storage chamber 18*b* to a desirable value.

Next, explanation will be given on cleaning of the paint supply circuit.

As the above mentioned, the cleaning fluid passage 20*a* is connected to the paint supply passage 20 near the paint lead-in part 12*c*, and the passage 20*c* for supplying cleaning air and the passage 20*d* for supplying cleaning solvent are connected to the cleaning fluid passage 20*a* through the control valve 20*b*. For example, if the coating machine 11 requires change of coating color from a color A to a color B, the paint valve 13 is opened.

Next, by operating the control valve 20*b*, one of the cleaning air passage 20*c* and the cleaning solvent passage 20*d* is alternately selected so as to supply its cleaning fluid (either the cleaning air or the cleaning solvent), whereby the paint of the color A adhering to the paint supply passage 20 and the rotary atomizing head 14 is removed. In this way, the cleaning of the paint supply passage 20 and the rotary atomizing head 14 is completed.

Subsequently, the cartridge 21 of the color A is detached from the cartridge storage chamber 18 and the cartridge 21 of the color B is attached thereto, whereby the changing of coating color is completed.

Incidentally, at the time of the above-mentioned cleaning, the check valve provided in the nozzle 45 of the cartridge 21 of the color A prevents the cleaning fluid from flowing into the cartridge 21 of the color A.

Cartridge

Next, explanation will be given on the construction of the cartridge 21.

Figure 5:
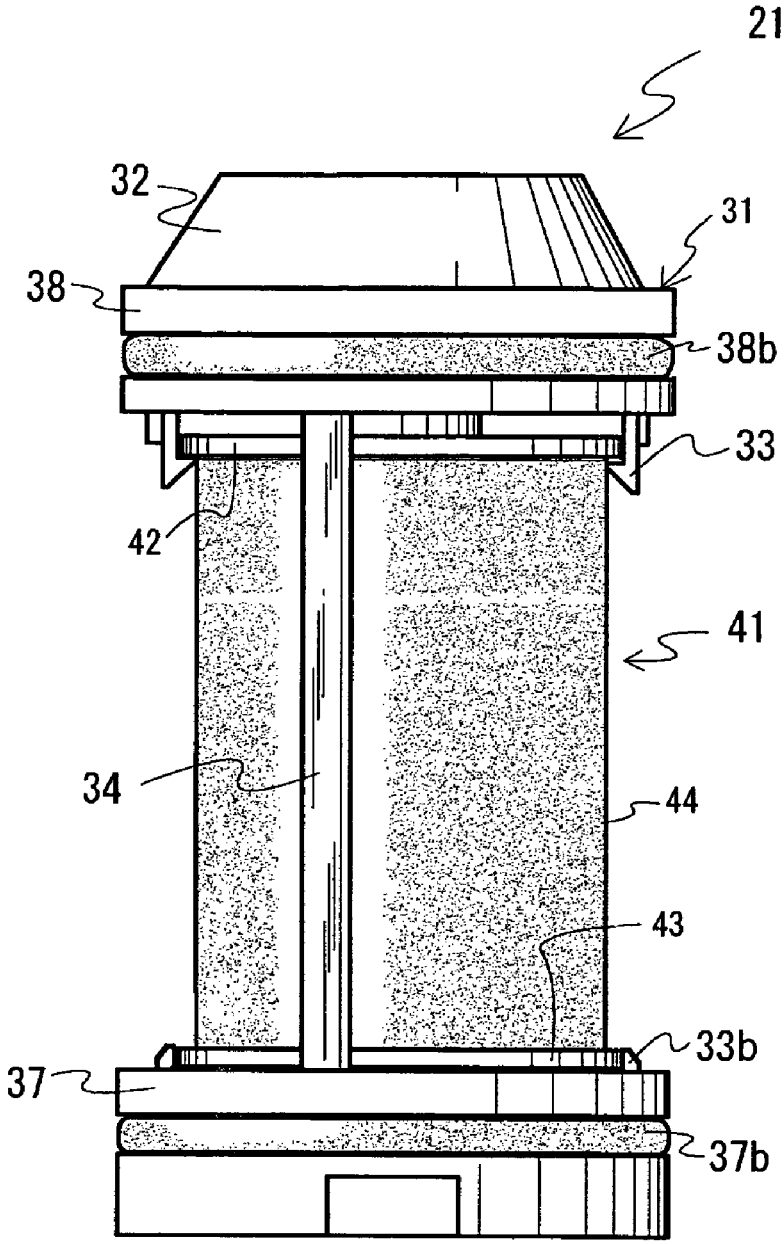
FIG. 5 is a side view of entire construction of the cartridge.
Figure 6:
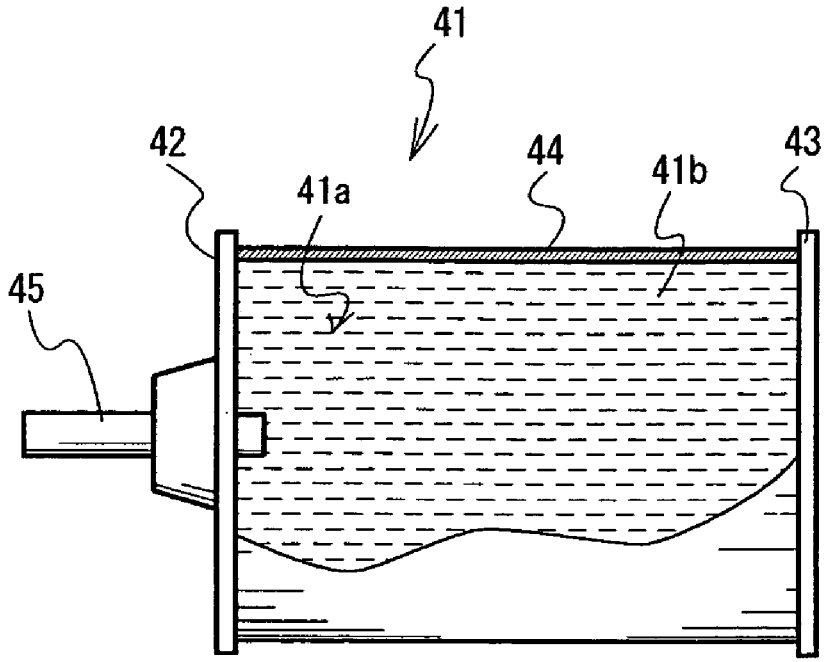
FIG. 6 is a side view partially in section of a paint unit.
Figure 7:
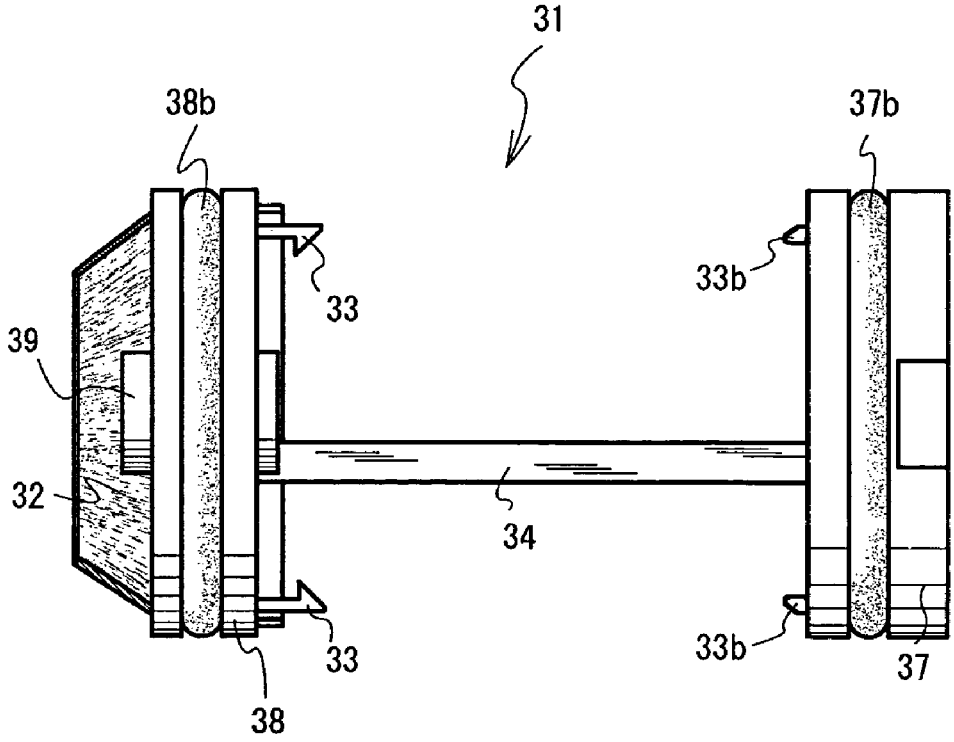
FIG. 7 is a side view partially in section of a casing.

FIG. 5 is a side view of entire construction of the cartridge, FIG. 6 is a side view partially in section of a paint unit, FIG. 7 is a side view partially in section of a casing, FIGS. 8(*a*), 8(*b*) and 8(*c*) illustrate a process of attaching the paint unit to the casing, and FIG. 9 is a sectional side view of the held paint unit.

As shown in FIG. 5, the cartridge 21 generally comprises the paint unit 41 storing paint and the casing 31 to which the paint unit 41 is detachably attached.

The cartridge 21, in the state of being stored in the cartridge storage chamber 18, constitutes a part of a paint supply system for supplying paint in the cartridge to the rotary atomizing head 14.

Furthermore, the cartridge 21 also serves as a lid closing the opening of the cartridge storage chamber 18. A rear frame 37 of the cartridge 21 prevents pressure solvent supplied into the pressure solvent storage chamber 18*b* of the cartridge storage chamber 18 from leaking out of the cartridge storage chamber 18. Accordingly, it is not necessary to provide another separate lid in the housing 12 of the coating machine 11 for closing the opening of the cartridge storage chamber 18, thereby simplifying the coating machine 11.

Explanation will be given on the construction of the paint unit 41.

The paint unit 41 functions as a paint storage tank for storing paint therein and, as shown in FIG. 6, comprises a front plate 42, a rear plate 43, a tube 44 and the nozzle 45. The tube 44 is a flexible member which can be easily deformed by receiving an external force. The front plate 42 and the rear plate 43 are formed of members with high rigidity such as to stably attach the paint unit 41 to the casing 31.

The front plate 42 and the rear plate 43, serving as lids of the tube 44, are liquid-tightly fitted to both ends of the tube 44, whereby the front plate 42, the rear plate 43 and the tube 44 constitute a paint storage chamber 41*a*. The nozzle 45 is disposed at a center of the front plate 42 so as to permit supplying of paint 41*b* from the paint storage chamber 41*a* toward the coating machine 11.

As shown in FIGS. 3 and 4, a check valve is disposed in the nozzle 45. The check valve permits the paint 41*b* to flow toward the paint supply passage 20 of the coating machine 11 when the cartridge 21 is stored in the cartridge storage chamber 18.

The tube 44 is a member constituting a side wall of the paint unit 41, and also is a membrane body forming the pressure solvent storage chamber 18*b* together with a front frame 38 and the rear frame 37 of the casing 31, when the cartridge 21 is stored in the cartridge storage chamber 18.

When the pressure solvent is supplied into the pressure solvent storage chamber 18*b*, the membrane body forming the tube 44 is easily deformable, and also solvent-resistant so as to resist against dissolution and degeneration by an organic solvent and penetration by solvent vapor. For example, in addition to a synthetic resin such as polyethylene and polypropylene, the tube 44 can be formed by metal foil, metal membrane body, or composite made by laminating resin and metal.

A member having bending modulus lower than 700 (kg/square centimeter) can be used as the flexible membrane body constituting the tube 44.

For forming the tube 44, any flexible member may serve as the tube 44 if it is easily deformed by the pressure of the pressure solvent. In addition to a member having elasticity (extendable and contractible) and a member having tensibility (extendable and not contractible), a member having little elasticity and tensibility, such as a laminate material made by laminating metal foil and resin foil, can be used.

With regard to the paint unit 41 constructed as the above, by pressurizing the tube 44 serving as the side wall thereof from the outside, the volume of the paint storage chamber 41*a* is reduced so that paint stored therein is pushed out through the nozzle 45.

Next, explanation will be given on the construction of the casing 31.

As shown in FIG. 7, the casing 31 comprises the front frame 38 and the rear frame 37, which serve as opposite side frames positioned at both sides of the paint unit 41 when the paint unit 41 is attached to the casing 31, and a stick-like connection frame 34 connecting the front frame 38 and the rear frame 37.

The front frame 38 and the rear frame 37 are disk-like shaped along an inner wall of the cartridge storage chamber 18. The front frame 38 and the rear frame 37 connected to each other through the connection frame 34 keeps a constant interval therebetween.

The casing 31 is substantially all-round opened (between the front frame 38 and the rear frame 37) so as to save the weight and secure an enough space into which the paint unit 41 is attached.

Diameters of the disk-like front frame 38 and rear frame 37 are slightly smaller than an inner diameter of the cartridge storage chamber 18. Circular grooves 38*c* and 37*c* (shown in FIG. 9) are engraved on outer peripheral surfaces of the frames 38 and 37, and elastic circular seals 38*b* and 37*b* are fitted into the grooves. The seals 38*b* and 37*b* keep the liquid-tightness of the pressure solvent storage chamber 18*b*, formed when the cartridge 21 is stored in the cartridge storage chamber 18.

A circular hole is formed at a center of the front frame 38. This hole permits the nozzle 45 of the paint unit 41 to be inserted into a nozzle holding part 39 when the paint unit 41 is attached to the casing 31.

A cylindrical nozzle guard 32 is provided at a front side of the front frame 38. The nozzle guard 32 prevents the nozzle 45 from being damaged by contacting with another member at the time of moving or conveying the cartridge 21.

The casing 31, constructed as the above, protects the tube 44 with a relatively low mechanical strength, and functions as a guide member for inserting and storing the cartridge 21 into the cartridge storage chamber 18. The casing 31 also functions as a partition member between the pressure solvent storage chamber 18*b* and the air storage chamber 18*c*. Namely, the pressure solvent storage chamber 18*b* is surrounded by the side wall of the cartridge storage chamber 18, the front frame 38 and the rear frame 37 of the casing 31, and the tube 44 of the paint unit 41. The air storage chamber 18*c* is surrounded by the inner wall of the cartridge storage chamber 18 and the front frame 38 of the casing 31.

Fixing hooks 33 are formed on the front frame 38, and guide projections 33*b* are formed on the rear frame 37.

By hooking the front plate 42 of the paint unit 41 onto the fixing hooks 33 of the front frame 38, the paint unit 41 attached to the casing 31 is held. The rear plate 43 of the paint unit 41 attached to the casing 31 is positioned by the guide projections 33*b* of the rear frame 37. Accordingly, the paint unit 41 can be fixed between the front frame 38 and the rear frame 37.

Specifically, the attachment of the paint unit 41 to the casing 31 is performed as shown in FIG. 8.

Firstly, as shown in FIG. 8(*a*), the paint unit 41, in which paint of a color for coating is stored, and the casing 31 are prepared. Next, as shown in FIG. 8(*b*), the nozzle 45 of the paint unit 41 is inserted into the front part of the casing 31, and the front part of the paint unit 41 is hooked onto the fixing hooks 33 of the front frame 38 in the casing 31, so that the paint unit 41 is held.

Subsequently, as shown in FIG. 8(*c*), the rear part of the paint unit 41 is guided by the guide projections 33*b* of the rear frame 37.

The attached paint unit 41 is substantially held and fixed by the fixing hooks 33 of the front frame 38. The guide projections 33*b* of the rear frame 37 are provided not for limiting the longitudinal position of the rear plate 43, but for guiding the rear plate 43 of the paint unit 41 so as to prevent it from slipping along the surface of the rear frame 37.

The casing 31, to which the paint unit 41 is attached, is substantially all-round opened between the front frame 38 and the rear frame 37, whereby the paint unit 41 can be attached to the casing 31 easily, and the state of the attached paint unit 41 can be checked easily.

The paint unit 41, substantially serving as a paint storage part in the cartridge 21, is formed separately from the casing 31 and detachably attached to the casing 31. Accordingly, the only thing required for filling the empty paint unit 41 with paint is to convey the light and handy empty paint unit 41 to a place for filling of paint, whereby a conveying equipment can be miniaturized.

With regard to the coating machine 11 constructed as the above, the pressure solvent storage chamber 18*b* for storing pressure solvent, which is liquid fluid for pressing paint, is constructed by the housing 12 and the cartridge 21. Accordingly, the cartridge 21 does not require another mechanism for pressing paint, whereby the cartridge 21 can be reduced in weight, size, and cost. The conveying equipment for the cartridge 21 can also be miniaturized.

Especially, the pressure solvent storage chamber 18*b* is formed by the front frame 38 and the rear frame 37 of the casing 31, the tube 44 serving as the side wall of the paint unit 41, and the inner wall of the cartridge storage chamber 18 covering the tube 44, so that the tube 44 is pressurized wholly equally by pressure solvent in the pressure solvent storage chamber 18*b*, thereby ensuring effective and accurate pressing-out of paint.

Next, explanation will be given on attachment/detachment between the cartridge storage chamber 18 and the cartridge 21.

FIGS. 10(*a*), 10(*b*) and 10(*c*) illustrate attachment/detachment between the cartridge 21 and the coating machine 11 and the state of spraying paint from the coating machine 11. FIG. 10(*a*) shows a state of the coating machine 11 fittingly provided with the cartridge 21, in which paint is stored, wherein the cartridge 21 is fittingly inserted into the opening of the cartridge storage chamber 18 formed at a rear part of the coating machine 11. FIG. 10(*b*) shows a state of the coating machine 11 during coating, wherein the paint in the cartridge 21 is supplied to the rotary atomizing head 14 and sprayed. FIG. 10(*c*) shows a state of the coating machine 11 after the coating, from which the cartridge 21 emptied of the paint is detached.

An exchanger (not shown) and the like, which may be provided independently of the coating machine 11, performs the attachment/detachment of the cartridge 21 to and from the coating machine 11.

Accordingly, the attachment/detachment of the cartridge 21 is performed for the above-mentioned change of coating colors.

As the above mentioned, when the cartridge 21 is inserted into the cartridge storage chamber 18 and stored therein, the tip of the nozzle 45 is directed to the bottom of the cartridge storage chamber 18. With regard to the air storage chamber 18*c* formed by the inner wall of the cartridge storage chamber 18 and the front frame 38 of the casing 31, the deeper the cartridge 21 is inserted into the cartridge storage chamber 18, the smaller the volume of the air storage chamber 18*c* becomes so that pressure therein tends to become high.

One of ends of the air passage 17 formed in the housing 12 of the coating machine 11 is opened toward the side of the cartridge storage chamber 18, and the other end thereof is opened toward the outside of the housing 12, whereby the air storage chamber 18*c* always is ventilated outward.

Accordingly, even if the volume of the air storage chamber 18*c* is reduced gradually and the pressure therein tends to become high, air in the air storage chamber 18*c* is discharged outward through the air passage 17 so that the pressure does not rise, whereby the cartridge 21 can be easily inserted into the fixed position in the cartridge storage chamber 18.

When the cartridge 21 is detached from the cartridge storage chamber 18, even if the volume of the air storage chamber 18*c* is increased gradually and the pressure therein tends to become negative, air is supplied from the outside of the housing 12 through the air passage 17, whereby the cartridge 21 can be detached easily.

Next, explanation will be given on a contraction process of the paint unit 41.

FIG. 12 is a schematic view of the cartridge pressurized by fluid pressure, FIG. 13 is a side view of the paint unit during a contraction process, and FIG. 14 is a perspective view of the paint unit emptied of paint therein.

As shown in FIG. 12, paint is supplied from the paint unit 41 to the rotary atomizing head 14 by charging pressure solvent into the pressure solvent storage chamber 18*b* through the pressure solvent passage 16 by a pump or the like so as to press out paint stored in the paint unit 41.

As shown in FIG. 13, as the paint is pushed out from the paint unit 41, a bending degree of the tube 44 becomes large. Accordingly, if the tube 44 is formed of a member having no elasticity or no tensibility, the rear plate 43 of the paint unit 41 slightly moves forward according to the increase of the bending degree of the tube 44. In this regard, the rear plate 43 of the paint unit 41 is not retained by the guide projections 33*b*, but is movable longitudinally. Accordingly, the tube 44 may be formed of a member having no elasticity or no tensibility.

Since the tube 44 is formed of a flexible member, paint stored therein can be pushed out substantially wholly, as shown in FIG. 14.

The tube 44 is fixed at its front part by the fixing hooks 33 and guided at its rear part by the guide projections 33*b*, and then pressurized from the side, whereby the tube 44 is difficult to be warped. Accordingly, excessive bending of a surface of the tube 44 following the reduction of the stored paint is restrained so that paint is supplied smoothly.

The bending degree of the tube 44 pressing out paint by the pressure of the pressure solvent may be reduced so as to reduce load applied on the tube 44, thereby improving durability of the tube 44. Accordingly, the tube 44 can be easily refilled with paint so as to improve its recyclability, thereby reducing the recycling cost of the paint unit 41.

When the cartridge 21, having the paint unit 41 attached to the casing 31, is detached from the coating machine 11, the tube 44 is protected by the casing 31, whereby the cartridge 21 can be easily handled.

Furthermore, the casing 31 has a number of openings so that the state of the tube 44 attached to the casing 31 can be recognized easily, whereby disorder of the tube 44, such as breakage, can be detected easily.

What is claimed is:

1. A cartridge-type coating machine comprising:

a housing;

a coating device disposed at a front part of the housing;

a cartridge storing paint therein and detachably attached to a rear part of the housing, wherein the paint in the cartridge is supplied to an atomizing head of the coating device by pressurizing the cartridge with liquid fluid;

wherein the cartridge comprises a paint unit, in which paint is stored, and a casing, to which the paint unit is attached; and a storage chamber, storing the liquid fluid defined by the housing and the cartridge.

2. A cartridge-type coating machine as set forth in claim 1, wherein the storage chamber is a space surrounded by an inner wall of a cartridge storage chamber to which the cartridge is attached, a side wall of the paint unit of the cartridge, and frames of the casing disposed at both sides of the paint unit; and wherein the paint is supplied to the atomizing head by pressurizing the side wall of the paint unit by the liquid fluid.

3. A cartridge-type coating machine as set forth in claim 1, wherein the paint unit is detachably attached to the casing.

4. A cartridge-type coating machine as set forth in claim 1, wherein the liquid fluid is a non-polar solvent.

5. A cartridge for a cartridge-type coating machine, comprising a paint unit storing paint to be supplied to a rotary atomizing head of the coating machine, wherein the cartridge is sized and configured to be detachably attached to a cartridge storage chamber formed in a housing of the coating machine; and wherein a space is defined between an inner wall of the cartridge storage chamber and the cartridge, said space being sized and configured to store liquid fluid for pressurizing the paint unit in the cartridge; and wherein the cartridge further comprises a casing, to which the paint unit is attached.

6. A cartridge for a cartridge-type coating machine as set forth in claim 5, wherein the paint unit comprises a paint storage chamber formed by a paint storage tube serving as a side wall of the paint storage chamber, and plate members blocking both ends of the paint storage tube; and wherein the paint storage tube is formed of a flexible membrane body deformable by external pressure.

7. A cartridge for a cartridge-type coating machine as set forth in claim 5, wherein the paint unit is detachably attached to the casing.

8. A cartridge-type coating machine, comprising:

a rotary atomizing head;

a cartridge including a paint unit storing paint to be supplied to the rotary atomizing head; and a cartridge storage chamber formed in a housing of the coating machine;

wherein the cartridge is sized and configured to be detachably attached to the cartridge storage chamber;

wherein a space is defined between an inner wall of the cartridge storage chamber and the cartridge, said space being sized and configured to store liquid fluid for pressurizing the paint unit in the cartridge; and wherein the cartridge further comprises a casing, to which the paint unit is attached.

9. A cartridge-type coating machine as set forth in claim 8, wherein the paint unit comprises a paint storage chamber formed by a paint storage tube serving as a side wall of the paint storage chamber, and plate members blocking both ends of the paint storage tube; and wherein the paint storage tube is formed of a flexible membrane body deformable by external pressure.

10. A cartridge-type coating machine as set forth in claim 8, wherein the paint unit is detachably attached to the casing.

* * * * *